US007056234B2

(12) United States Patent
Kasashima

(10) Patent No.: US 7,056,234 B2
(45) Date of Patent: Jun. 6, 2006

(54) MULTI-PIECE SOLID GOLF BALL

(75) Inventor: Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 273 days.

(21) Appl. No.: 10/219,670

(22) Filed: Aug. 16, 2002

(65) Prior Publication Data

US 2003/0050138 A1 Mar. 13, 2003

(30) Foreign Application Priority Data

Aug. 24, 2001 (JP) ..... 2001-254259

(51) Int. Cl.
*A63B 37/12* (2006.01)

(52) U.S. Cl. ..... 473/384

(58) Field of Classification Search ..... 473/378–385
See application file for complete search history.

(56) References Cited

U.S. PATENT DOCUMENTS

| | | | | |
|---|---|---|---|---|
| 5,072,945 | A * | 12/1991 | Oka et al. | 473/384 |
| 6,210,293 | B1 * | 4/2001 | Sullivan | 473/374 |
| 6,224,499 | B1 * | 5/2001 | Ogg | 473/383 |

FOREIGN PATENT DOCUMENTS

| | | |
|---|---|---|
| JP | 63-158075 | 7/1988 |
| JP | 2000-325499 | 11/2000 |

* cited by examiner

*Primary Examiner*—Raeann Gorden
(74) *Attorney, Agent, or Firm*—Sughrue Mion, PLLC

(57) ABSTRACT

In a multi-piece solid golf ball comprising an elastic solid core, an intermediate layer of ionomer resin, and a cover of urethane elastomer having a plurality of dimples on its surface, those dimples disposed in one or more rows adjacent to the equator have a greater depth and/or volume than the remaining dimples in other areas. The variation of flight performance of the ball with impact points is minimized.

17 Claims, 4 Drawing Sheets

MULTI-PIECE SOLID GOLF BALL

This invention relates to multi-piece solid golf balls comprising an elastic solid core and a cover including at least two layers of different resin materials and exhibiting uniform flight performance.

BACKGROUND OF THE INVENTION

The golf balls are now under a rapid transition from the thread wound structure to the solid structure because most golfers favor the superior distance performance of solid balls.

The solid structure is initially typified by two-piece solid golf balls in which a solid core of rubber having excellent resilience is disposed at the center of the ball as the majority thereof and enclosed with a hard resin cover formed of ionomer resins or the like for providing protection against external damages.

Although the solid ball is good in distance, it undergoes a smaller deformation upon impact than the wound golf ball. The solid ball then gives a hard or unpleasant feel when hit. Since the smaller deformation corresponds to a smaller area of contact with the club face, the solid ball receives less spin and is thus less controllable on use of an iron club.

Many attempts were made to overcome these drawbacks, for example, by reducing the hardness of the solid core, placing a buffer layer between the core and the cover to form a three-layer structure, and using relatively flexible polyurethane as the outermost cover stock in the three-layer structure.

As a consequence, the feel and spin rate are improved to a substantially satisfactory level. Particularly when a polyurethane cover is used as the outermost layer in the three-layer structure, spin receptivity is improved over the ionomer resin covered balls. For the same reason of spin receptivity, however, the travel distance of the ball is not increased as expected when hit with a driver or a similar club intended for distance. Such shortage of travel distance can be compensated for by adjusting the hardnesses and gages of the core and two resin cover layers so that the spin receptivity of the ball when hit with a driver is reduced while the spin receptivity of the ball when hit with an iron club is kept unchanged. This technology has been established in a substantial sense.

By reducing or suppressing the spin the ball receives when hit with a driver, the distance characteristic of the solid golf ball is advantageously ensured. As a consequence of the reduced spin on driver shots, the difference in trajectory between pole hit (ball spins about axis on equatorial plane) and seam hit (ball spins about pole-to-pole axis) which has not been distinctly recognized by players becomes more significant.

The difference between pole hit and seam hit is described in detail. Most often, golf balls are molded using a mold composed of two mold halves which are removably joined to define a spherical cavity therein. Since the ball is molded in axisymmetry, the ball tends to have a lower sphericity about an axis existing on a plane circumscribed by a parting line (or equator) corresponding to the center of a line connecting the apexes (or poles) of the cavities of the mold halves. Owing to such a difference in sphericity, the prior art golf ball has a possibility that flight performance differs depending on the position where it is hit. In the golf play where the ball shall not be moved except in a special situation and shall be played as it lies according to the rules of golf, the variation in flight distance becomes a significant problem.

SUMMARY OF THE INVENTION

An object of the present invention is to provide a performance with impact points is minimized so that equal flight performance is exerted on either pole hit or seam hit.

The invention addresses a multi-piece solid golf ball comprising an elastic solid core, an intermediate layer around the core, composed mainly of an ionomer resin, and a resin cover around the intermediate layer, composed mainly of a urethane elastomer and having a plurality of dimples on its surface. It has been found that when those dimples residing in opposite areas disposed adjacent to the equator of the ball have a greater depth and/or volume than the remaining dimples in other areas, the flight performance of the ball is not significantly different between pole hit and seam hit. That is, the variation in flight performance of the ball with impact points is minimized.

According to the invention, there is provided a multi-piece solid golf ball comprising an elastic solid core, an intermediate layer around the core, composed mainly of an ionomer resin, and a resin cover around the intermediate layer, composed mainly of a urethane elastomer and having a plurality of dimples on its surface. The ball has an equator and a pair of opposed poles.

In a first aspect, those dimples residing in opposite areas disposed adjacent to the equator have a greater depth than the remaining dimples in other areas. In a preferred embodiment, the equator is interposed between a pair of juxtaposed dimple rows in which the dimples having a greater depth are continuously or intermittently arranged; or the equator is interposed between plural pairs of juxtaposed dimple rows in which the dimples having a greater depth are continuously or intermittently arranged.

In a second aspect, the ball has an equator, and those dimples residing in opposite areas disposed adjacent to the equator have a greater volume than the remaining dimples in other areas. In a preferred embodiment, the equator is interposed between a pair of juxtaposed dimple rows in which the dimples having a greater volume are continuously or intermittently arranged; or the equator is interposed between plural pairs of juxtaposed dimple rows in which the dimples having a greater volume are continuously or intermittently arranged.

In a further preferred embodiment of the first and second aspects, dimples in each of polar areas are arranged generally about the pole and surround the pole such that the line segments connecting the centers of the dimples define a pentagon; or dimples in each of polar areas are arranged generally about the pole and surround the pole such that the line segments connecting the centers of the dimples define a hexagon.

Most often, the cover has a gage of 0.7 to 1.7 mm and the intermediate layer has a gage of 1.0 to 2.0 mm, and the intermediate layer is harder than the cover.

BRIEF DESCRIPTION OF THE DRAWINGS

The above and other objects, features and advantages of the invention will be better understood from the following description taken in conjunction with the accompanying drawings.

DESCRIPTION OF THE PREFERRED EMBODIMENTS

It is noted that the term "radial" as used herein is a radial direction extending from the center of the ball. When a preferred range, such as 5 to 25, is given, this means preferably not less than 5, and separately and independently, preferably not more than 25.

Figure 1:
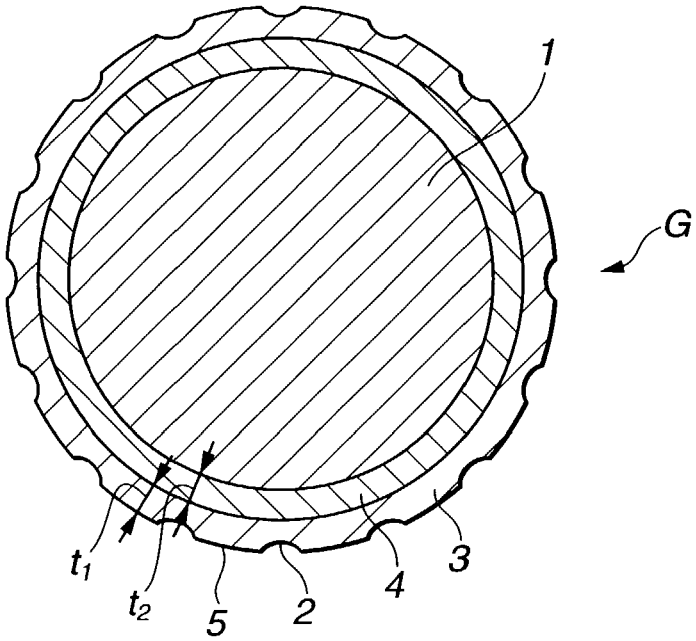
FIG. 1 is a schematic cross-sectional view of a multi-piece solid golf ball according to the invention.

Referring to FIG. 1, the golf ball of the invention is a multi-piece solid golf ball, generally designated at G, including an elastic solid core 1 which is concentrically enclosed with a resin layer including two layers, an intermediate layer 4 and a cover 3 having a plurality of dimples 2 on its surface. The intermediate layer 4 is disposed between the core 1 and the cover 3.

The elastic solid core is made of any well-known material, preferably a rubber composition. The preferred rubber composition uses polybutadiene as the base rubber. The preferred polybutadiene is cis-1,4-polybutadiene containing at least 40% by weight of cis structure. In the base rubber, natural rubber, polyisoprene rubber or styrene-butadiene rubber may be blended with the polybutadiene, if desired. Increasing the rubber component is effective for improving the rebound of the resulting golf ball. In addition to the base rubber, the rubber composition may contain other ingredients well-known for core materials, for example, unsaturated carboxylic acids and/or metal salts thereof, organic peroxides, and organic sulfur compounds.

The elastic solid core may be prepared by molding, vulcanizing and curing the rubber composition in a well-known manner.

The elastic solid core generally has a diameter of at least 34.0 mm, preferably at least 35.0 mm and up to 39.0 mm, preferably up to 38.0 mm. This diameter range is recommended to ensure improved flight performance.

Preferably the elastic solid core has such a hardness that the core rested on a rigid plate undergoes a deformation of 2.7 mm to 4.5 mm when the load applied thereto is increased from 98 N (10 kgf) to 1275 N (130 kgf).

The elastic solid core is enclosed with the intermediate layer which is formed from an ionomer resin composition.

The intermediate layer should preferably have a surface Shore D hardness of at least 50, preferably at least 55 and up to 70, preferably up to 65. It is noted that the surface Shore D hardness is a hardness measured at the surface of a sphere, and this terminology is equally applicable to the intermediate layer and the cover. If the intermediate layer is too soft, the ball may receive more spin on any shot, which leads to a shorter travel distance, and give a too soft feel. Too hard an intermediate layer may lead to a less spin rate, control difficulty, a hard feel, and poor anti-cracking durability upon repetitive shots.

In forming the intermediate layer, one or more of well-known ionomer resins may be selected or combined so as to fulfil the above Shore D hardness requirement.

The intermediate layer has a gage or radial thickness (mm) designated "$t_2$" in FIG. 1. It is recommended that the gage $t_2$ be in the range of 1.0 mm to 2.0 mm. Desirably the gage $t_2$ is equal to or slightly greater than the gage $t_1$ of the cover to be described later.

Preferably a sphere consisting of the core and the intermediate layer has such a hardness that the sphere rested on a rigid plate undergoes a deformation of 2.5 to 3.5 mm when the load applied thereto is increased from 98 N (10 kgf) to 1275 N (130 kgf).

The intermediate layer is enclosed with the cover which is composed mainly of a urethane elastomer. The urethane elastomer may be either a thermoplastic or thermosetting polyurethane elastomer. The cover can be formed by a conventional method.

The cover should preferably have a surface Shore D hardness of 45 to 58, and more preferably 47 to 58. It is recommended that the Shore D hardness of the cover be lower than that of the intermediate layer. If the cover is too soft, a more spin rate on every shot may result in a decline of distance and the feel may become too soft. If the cover is too hard, a less spin rate may result in difficulty to control and the feel may become harder.

While it is already recommended that the surface hardness of the cover be lower (or softer) than that of the intermediate layer, it is further recommended that the difference in Shore D hardness between the intermediate layer and the cover be at least 5 units, especially at least 8 units and up to 20 units, especially up to 15 units. Too less a hardness difference may lead to insufficient spin performance on iron and approach shots whereas too much a hardness difference may adversely affect durability.

In forming the cover, any appropriate one may be selected from well-known polyurethanes so as to fulfil the above hardness requirement.

The cover 3 has a gage or radial thickness between the outer surface of the intermediate layer 4 and the outer surface of the cover 3 where no dimples are formed, that is, land 5 and designated at "$t_1$" in FIG. 1. It is recommended that the cover gage $t_1$, be in the range of 0.7 mm to 1.7 mm.

Preferably the multi-piece solid golf ball comprising the aforementioned core, intermediate layer and cover has such a hardness that the ball rested on a rigid plate undergoes a distortion of 2.5 to 3.5 mm when the load applied thereto is increased from 98 N (10 kgf) to 1275 N (130 kgf).

The multi-piece solid golf ball of the invention has on the cover surface a plurality of dimples which should be arranged as follows according to the invention. It is assumed that the ball has an equator corresponding to a parting line and a pair of opposed poles; and that each dimple has a depth and a volume and more specifically, a dimple defines a cavity between the plane circumscribed by the dimple edge and the dimple wall, and the dimple volume is the volume of this cavity.

(1) Those dimples residing adjacent to the equator have a greater depth or volume than the remaining dimples in other areas. For example, in an embodiment wherein the dimples residing adjacent to the equator have the same diameter as the dimples in other areas, the dimples residing adjacent to the equator are increased in depth or volume or in both depth and volume.

(2) Dimples having a greater depth are continuously or intermittently arranged in one, two or three rows on each of opposite sides of the equator and parallel to the equator.

(3) Reference is made to the embodiment wherein deeper or greater volume dimples are arranged in plural rows, for example, three rows on each of opposite sides of the equator. With respect to depth, dimples which are substantially equally deeper are arranged in the three rows. Alternatively, deepest dimples are arranged in the row close to the equator, and shallower dimples are arranged in a row more remote from the equator.

(4) In the same embodiment as (3), those deeper dimples residing adjacent to the equator are preferably 5 μm to 60 μm deeper than the deepest dimples in the remaining areas. Those greater volume dimples residing adjacent to the equator are preferably 2 to 30% greater in volume than the largest volume dimples in the remaining areas.

Figure 2:
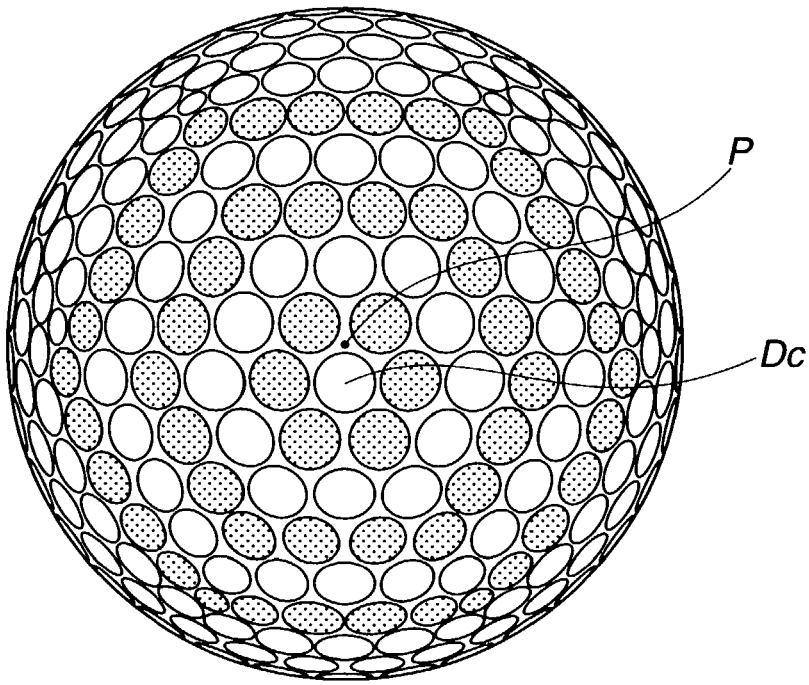
FIG. 2 is a plan view as viewed from above the pole of one exemplary golf ball according to the invention, with a dimple arrangement mode of arranging dimples in a hexagonal pattern centered proximate the poles.
Figure 4:
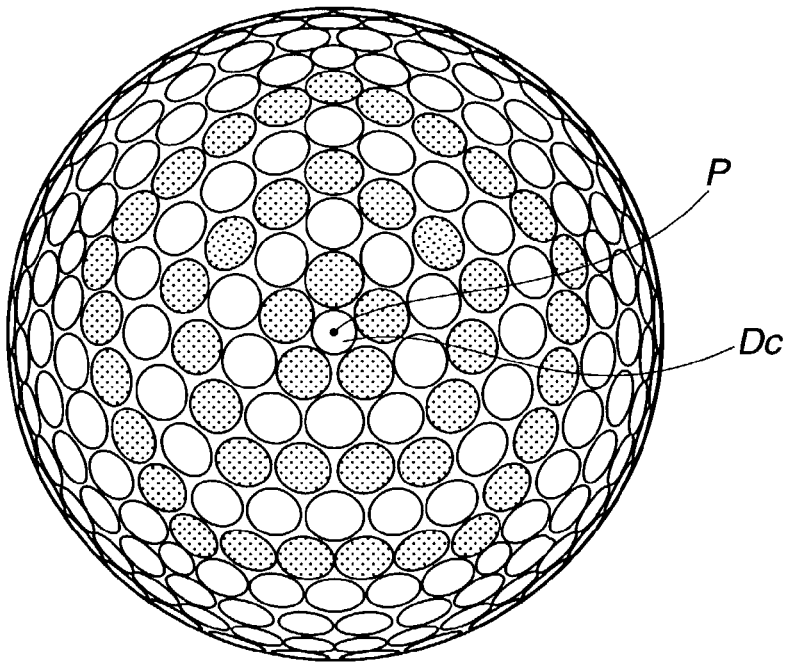
FIG. 4 is a plan view as viewed from above the pole of another exemplary golf ball according to the invention, with a dimple arrangement mode of arranging dimples in a pentagonal pattern centered at the poles.

(5) At the same time, dimples are preferably arranged in a pentagonal or hexagonal pattern in a polar area because better effects are exerted. The arrangement of dimples in a pentagonal or hexagonal pattern means that as shown in FIGS. 2 and 4, when dimples are arranged around a central dimple Dc which is centered at or proximate the pole P, the line segments connecting the centers of the dimples surrounding the central dimple Dc define a pentagon or hexagon, more preferably a regular pentagon or regular hexagon.

(6) With respect to the dimple arrangement, the dimples are preferably arranged such that there is no great circle that does not intersect with dimples or if any, only one great circle that does not intersect with dimples is present at the equator.

Aside from arranging dimples as described above, dimples of plural types which differ in diameter and/or depth may be used and arranged.

Preferably the shape of dimples is circular as viewed in a plane (orthogonal to a radial direction). It is recommended that dimples which are circular in planar shape have a diameter of 2.0 to 5.0 mm, especially 2.5 to 4.5 mm, a depth of 0.05 to 0.4 mm, especially 0.08 to 0.30 mm, and a volume of 0.2 to 1.5 $mm^3$.

The total number of dimples on the golf ball is not critical although it is usually at least 300, especially at least 360 and up to 550, especially up to 500.

The total dimple volume given as the sum of the volumes of all dimples should preferably be 280 to 370 $mm^3$. With a total dimple volume of less than 280 $mm^3$, the ball will travel a too high trajectory when hit with a driver. With a total dimple volume of more than 370 $mm^3$, the trajectory may become too low. In both cases, the travel distance becomes short against the purpose of the invention.

Provided that the dimple area is the area of a planar circle circumscribed by the dimple edge, the total of dimple areas preferably accounts for 78 to 85% of the spherical surface area of the ball which is assumed to be dimple-free. A percent dimple occupation within this range is effective for improving flight performance.

EXAMPLE

Examples of the invention are given below by way of illustration and not by way of limitation.

Examples 1–6 & Comparative Examples 1–5

Golf balls of a common three-piece solid structure consisting of a monolithic core of rubber, a single intermediate layer of ionomer resin and a single layer cover of polyurethane were prepared. The parameters and arrangement of dimples are shown in Table 1 and FIGS. 2 to 7. The components and construction of balls are shown in Table 2.

Figure 3:
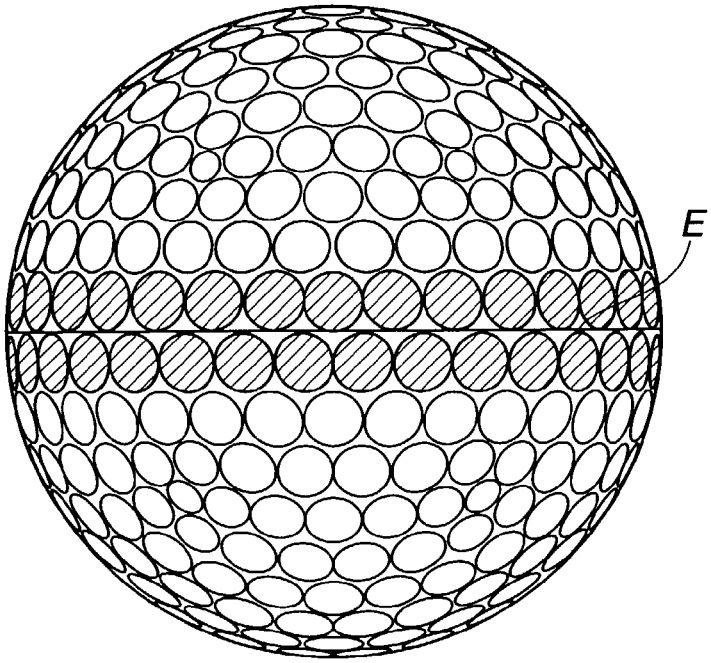
FIG. 3 is a side view as viewed from above the equator of the same ball as FIG. 2.

FIGS. 2 and 3 illustrate one exemplary golf ball on which dimples are arranged in a hexagonal pattern centered proximate each pole. FIG. 2 is a plan view as viewed from above the pole and FIG. 3 is a side view as viewed from above the equator. In this arrangement, a central dimple Dc of the hexagonal arrangement pattern is somewhat shifted from the pole P, and dimples are arranged about the central dimple Dc in 1st, 2nd, 3rd, 4th and 5th rows and all in a hexagonal pattern. Arrangement modes A, A' and "a" in Table 1 are applied to this ball.

In arrangement mode A including first dimples having a diameter of 3.95 mm (maximum) and a depth of 0.16 mm, fifth dimples of the same diameter, but having a greater depth of 0.18 mm (maximum) are arranged in a row on each side of the equator E as shown in FIG. 3. It is understood that the fifth dimples in arrangement mode A have a maximum volume due to the increased depth.

Like arrangement mode A, in arrangement mode A' including first dimples having a diameter of 3.95 mm (maximum) and a depth of 0.16 mm, fifth dimples of the same depth, but having a greater volume (maximum) are arranged in a row on each side of the equator.

In arrangement mode "a" serving as a comparative example, dimples are arranged uniformly according to a conventional technique, without resorting to the concept that those dimples having a greater depth and/or volume are disposed adjacent to the equator.

Figure 5:
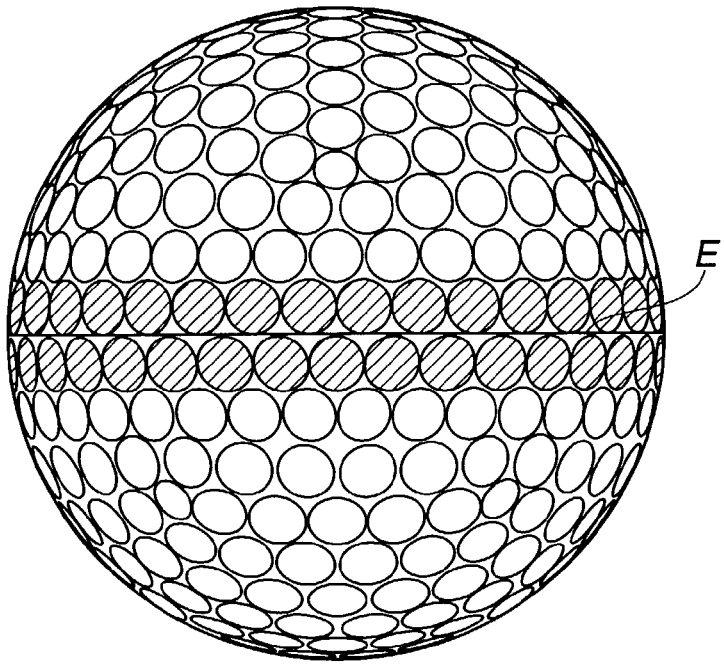
FIG. 5 is a side view as viewed from above the equator of the same ball as FIG. 4.

FIGS. 4 and 5 illustrate another exemplary golf ball on which dimples are arranged in a pentagonal pattern centered at each pole. FIG. 4 is a plan view as viewed from above the pole and FIG. 5 is a side view as viewed from above the equator. In this arrangement, a central dimple Dc of the pentagonal arrangement pattern is centered at the pole P, and dimples are arranged about the central dimple Dc in 1st, 2nd, 3rd, 4th and 5th rows and all in a pentagonal pattern. Arrangement modes B and "b" in Table 1 are applied to this ball.

Like arrangement mode A, in arrangement mode B including first dimples having a diameter of 3.95 mm (maximum) and a depth of 0.16 mm, fifth dimples of the same diameter, but having a greater depth of 0.18 mm (maximum) and hence, a maximum volume are arranged in a row on each side of the equator E as shown in FIG. 5.

Like arrangement mode "a," in arrangement mode "b" serving as a comparative example, dimples are arranged uniformly according to a conventional technique, without resorting to the concept that those dimples having a greater depth and/or volume are disposed adjacent to the equator.

Figure 6:
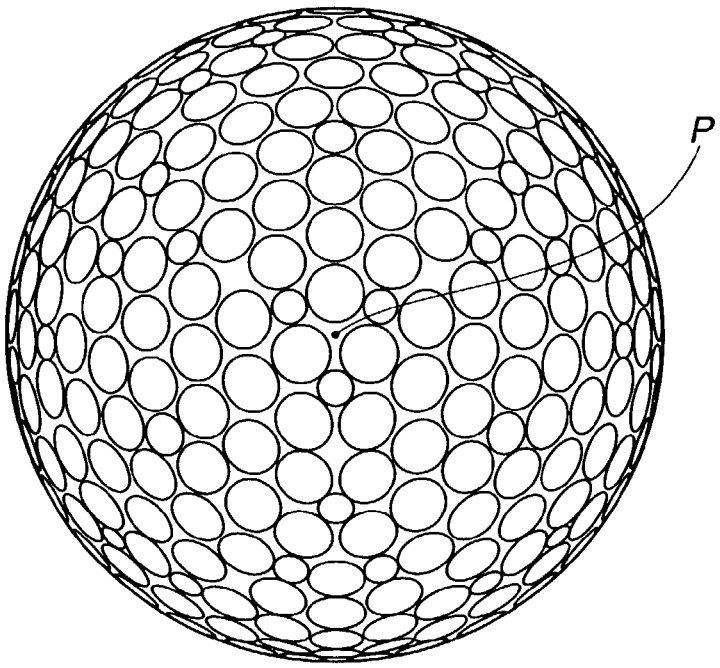
FIG. 6 is a plan view as viewed from above the pole of a further exemplary golf ball according to the invention, with a dimple arrangement mode of arranging dimples uniformly on the spherical surface such that there is no great circle that does not intersect with dimples.
Figure 7:
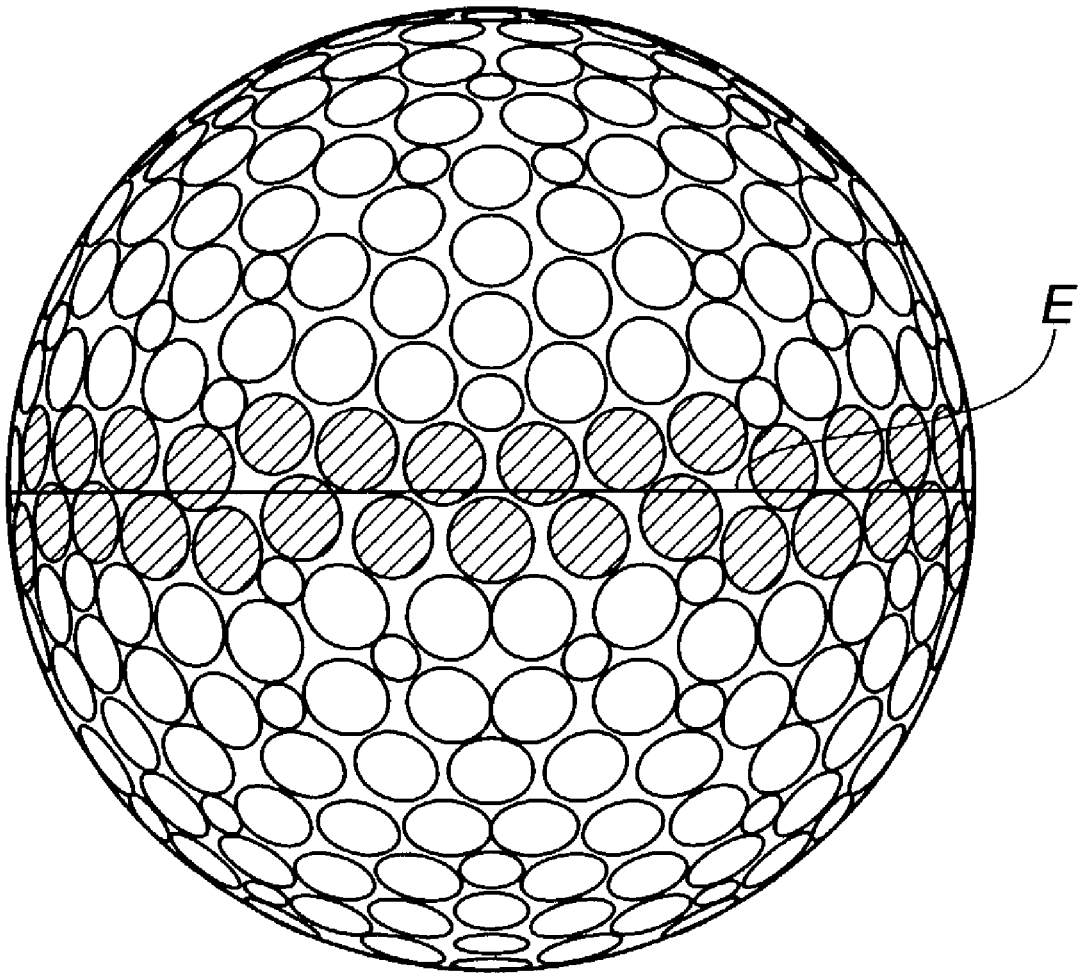
FIG. 7 is a side view as viewed from above the equator of the same ball as FIG. 6.

FIGS. 6 and 7 illustrate a further exemplary golf ball on which dimples are arranged uniformly on the spherical surface such that there is no great circle that does not intersect with dimples, without following any particular arrangement pattern. FIG. 6 is a plan view as viewed from above the pole and FIG. 7 is a side view as viewed from above the equator. Arrangement modes C and "c" shown in Table 1 are applied to this ball.

In arrangement mode C including first and second dimples having a diameter of 3.9 mm and 3.8 mm, respectively, fifth and sixth dimples of the same diameters, but having a greater depth and volume are combined and arranged on each side of the equator. Like arrangement modes "a" and "b," in arrangement mode "c" serving as a comparative example, dimples are arranged uniformly conventional technique, without resorting to the inventive concept.

TABLE 1

| | Dimples | | | | | | | | |
|---|---|---|---|---|---|---|---|---|---|
| Arrangement mode | Dimple type | Number | Diameter (mm) | Depth (mm) | Volume ($mm^3$) | Vo | Total number | Total volume ($mm^3$) | VR |
| A | 1 | 60 | 3.95 | 0.16 | 0.980 | 0.50 | 414 | 358 | 0.88 |
| | 2 | 216 | 3.75 | 0.16 | 0.884 | 0.50 | | | |
| | 3 | 60 | 3.30 | 0.14 | 0.539 | 0.45 | | | |
| | 4 | 12 | 2.50 | 0.11 | 0.232 | 0.43 | | | |
| | 5 | 66 | 3.95 | 0.18 | 1.103 | 0.50 | | | |
| A' | 1 | 60 | 3.95 | 0.16 | 0.980 | 0.50 | 414 | 357 | 0.88 |
| | 2 | 216 | 3.75 | 0.16 | 0.884 | 0.50 | | | |
| | 3 | 60 | 3.30 | 0.14 | 0.539 | 0.45 | | | |
| | 4 | 12 | 2.50 | 0.11 | 0.232 | 0.43 | | | |
| | 5 | 66 | 3.95 | 0.16 | 1.098 | 0.56 | | | |
| a | 1 | 126 | 3.95 | 0.16 | 0.980 | 0.50 | 414 | 349 | 0.86 |
| | 2 | 216 | 3.75 | 0.16 | 0.884 | 0.50 | | | |
| | 3 | 60 | 3.30 | 0.14 | 0.539 | 0.45 | | | |
| | 4 | 12 | 2.50 | 0.11 | 0.232 | 0.43 | | | |
| B | 1 | 80 | 3.95 | 0.16 | 0.980 | 0.50 | 412 | 355 | 0.87 |
| | 2 | 180 | 3.75 | 0.16 | 0.884 | 0.50 | | | |
| | 3 | 70 | 3.55 | 0.14 | 0.624 | 0.45 | | | |
| | 4 | 12 | 3.15 | 0.11 | 0.369 | 0.43 | | | |
| | 5 | 70 | 3.75 | 0.18 | 0.994 | 0.50 | | | |
| b | 1 | 80 | 3.95 | 0.16 | 0.980 | 0.50 | 412 | 347 | 0.85 |
| | 2 | 250 | 3.75 | 0.16 | 0.884 | 0.50 | | | |
| | 3 | 70 | 3.55 | 0.14 | 0.624 | 0.45 | | | |
| | 4 | 12 | 3.15 | 0.11 | 0.369 | 0.43 | | | |
| C | 1 | 246 | 3.90 | 0.16 | 0.860 | 0.45 | 432 | 334 | 0.82 |
| | 2 | 48 | 3.80 | 0.16 | 0.817 | 0.45 | | | |
| | 3 | 12 | 2.90 | 0.14 | 0.435 | 0.47 | | | |
| | 4 | 60 | 2.50 | 0.11 | 0.238 | 0.44 | | | |
| | 5 | 54 | 3.90 | 0.18 | 0.968 | 0.45 | | | |
| | 6 | 12 | 3.80 | 0.18 | 0.919 | 0.45 | | | |
| c | 1 | 300 | 3.90 | 0.16 | 0.860 | 0.45 | 432 | 326 | 0.80 |
| | 2 | 60 | 3.80 | 0.16 | 0.817 | 0.45 | | | |
| | 3 | 12 | 2.90 | 0.14 | 0.435 | 0.47 | | | |
| | 4 | 60 | 2.50 | 0.11 | 0.238 | 0.44 | | | |

Note that Vo is the volume of a dimple divided by the volume of a cylinder whose diameter is the dimple diameter and whose height is the dimple depth; and VR is the total area of dimples divided by the surface area of the ball.

TABLE 2

| | | Example | | | | | | Comparative Example | | | | |
|---|---|---|---|---|---|---|---|---|---|---|---|---|
| | | 1 | 2 | 3 | 4 | 5 | 6 | 1 | 2 | 3 | 4 | 5 |
| Core | Deformation under load (mm) | 3.5 | 3.9 | 3.3 | 3.6 | 3.1 | 3.5 | 3.5 | 3.9 | 3.3 | 3.6 | 3.1 |
| Inter-mediate layer | Gage (mm) | 1.65 | 1.20 | 1.65 | 1.20 | 1.65 | 1.65 | 1.65 | 1.20 | 1.65 | 1.20 | 1.65 |
| | Shore D hardness | 63 | 61 | 63 | 66 | 63 | 63 | 63 | 61 | 63 | 66 | 63 |
| | Deformation under load (mm) | 2.9 | 3.4 | 2.7 | 3.0 | 2.6 | 2.9 | 2.9 | 3.4 | 2.7 | 3.0 | 2.6 |
| Cover | Gage (mm) | 1.5 | 1.2 | 1.5 | 1.5 | 1.5 | 1.5 | 1.5 | 1.2 | 1.5 | 1.5 | 1.5 |
| | Shore D hardness | 47 | 47 | 50 | 50 | 53 | 47 | 47 | 47 | 50 | 50 | 53 |
| Ball | Dimple arrangement mode | A | A | B | B | C | A' | a | a | b | b | c |
| | Deformation under load (mm) | 2.6 | 3.0 | 2.4 | 2.6 | 2.3 | 2.6 | 2.6 | 3.0 | 2.4 | 2.6 | 2.3 |
| Carry variation (m) | | 1.2 | 1.5 | 1.0 | 1.8 | 0.5 | 1.3 | 3.2 | 3.6 | 2.8 | 3.1 | 2.8 |

Note:
(1) Deformation under load is a deformation of any sphere when the load applied thereto is increased from 98 N (10 kgf) to 1275 N (130 kgf).
(2) Deformation under load of the intermediate layer is that of the intermediate layer enclosing the core.
(3) Carry variation is a difference between an average carry upon twelve pole hits and an average carry upon twelve seam hits.
(4) The variation was determined using a hitting machine equipped with a driver (W#1) and at a head speed of 48 m/s.

There have been described multi-piece solid golf balls which minimize the variation of flight performance with impact points.

Japanese Patent Application No. 2001-254259 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising an elastic solid core, an intermediate layer around the core, composed mainly of an ionomer resin, and a resin cover around the intermediate layer, composed mainly of a urethane elastomer and having a plurality of dimples on its surface, wherein the ball has an equator, and those dimples residing in opposite areas disposed adjacent to the equator have a greater depth than the remaining dimples in other areas, there is no great circle on the spherical surface of the ball that does not intersect with dimples, and the total dimple volume given as the sum of the volumes of all dimples is 280 to 370 $mm^3$, and wherein said elastic core undergoes a deformation of 2.7 to 4.5 mm when a load applied thereto is increased from 98 N (10 kgf) to 1275 N (130 kgf); a sphere including the elastic core and the intermediate layer undergoes a deformation of 2.5 to 3.5 mm when a load applied thereto is increased from 98 N (10 kgf) to 1275 N (130 kgf); and the solid golf ball comprising the elastic core, the intermediate layer and the cover undergoes a deformation of 2.3 to 3.5 mm when a load applied thereto is increased from 98 N (10 kgf) to 1275 N (130 kgf).

2. The multi-piece solid golf ball of claim 1 wherein said cover and said intermediate layer have a gage of 0.7 to 1.7 mm and 1.0 to 2.0 mm, respectively.

3. The multi-piece solid golf ball of claim 1 wherein said intermediate layer is harder than said cover.

4. The multi-piece solid golf ball of claim 1 wherein the total of dimple areas accounts for 78 to 85% of the spherical surface area of the ball which is assumed to be dimple-free.

5. The multi-piece solid golf ball of claim 1 wherein the dimples residing adjacent to the equator are 5 μm to 60 μm deeper than the deepest dimples in the remaining areas.

6. The multi-piece solid golf ball of claim 1 wherein provided that the deformation of the elastic core is $\mu_1$, the deformation of the sphere including the elastic core and the intermediate layer is $\mu_2$, and the deformation of the solid golf ball comprising the elastic core, the intermediate layer and the cover is $\mu_3$, these deformations are satisfied by:

$$\mu_1>\mu_2>\mu_3.$$

7. A multi-piece solid golf ball comprising an elastic solid core, an intermediate layer around the core, composed mainly of an ionomer resin, and a resin cover around the intermediate layer, composed mainly of a urethane elastomer and having a plurality of dimples on its surface, wherein the ball has an equator, and those dimples residing in opposite areas disposed adjacent to the equator have a greater depth than the remaining dimples in other areas, there is no great circle on the spherical surface of the ball that does not intersect with dimples, and the total dimple volume given as the sum of the volumes of all dimples is 280 to 370 $mm^3$, and the ball has opposed poles, and dimples in each of polar areas are arranged generally about the pole and surround the pole such that the line segments connecting the centers of the dimples define a pentagon.

8. A multi-piece solid golf ball comprising an elastic solid core, an intermediate layer around the core, composed mainly of an ionomer resin, and a resin cover around the intermediate layer, composed mainly of a urethane elastomer and having a plurality of dimples on its surface, wherein the ball has an equator, and those dimples residing in opposite areas disposed adjacent to the equator have a greater depth than the remaining dimples in other areas, there is no great circle on the spherical surface of the ball that does not intersect with dimples, and the total dimple volume given as the sum of the volumes of all dimples is 280 to 370 $mm^3$, and the ball has opposed poles, and dimples in each of polar areas are arranged generally about the pole and surround the pole such that the line segments connecting the centers of the dimples define a hexagon.

9. A multi-piece solid golf ball comprising an elastic solid core, an intermediate layer around the core, composed mainly of an ionomer resin, and a resin cover around the intermediate layer, composed mainly of a urethane elastomer and having a plurality of dimples on its surface, wherein the ball has an equator, and those dimples residing in opposite areas disposed adjacent to the equator have a greater volume than the remaining dimples in other areas, there is no great circle on the spherical surface of the ball that does not intersect with dimples, and the total dimple volume given as the sum of the volumes of all dimples is 280 to 370 $mm^3$, and wherein said elastic core undergoes a deformation of 2.7 to 4.5 mm when a load applied thereto is increased from 98 N (10 kgf) to 1275 N (130 kgf); a sphere including the elastic core and the intermediate layer undergoes a deformation of 2.5 to 3.5 mm when a load applied thereto is increased from 98 N (10 kgf) to 1275 N (130 kgf); and the solid golf ball comprising the elastic core, the intermediate layer and the cover undergoes a deformation of 2.3 to 3.5 mm when a load applied thereto is increased from 98 N (10 kgf) to 1275 N (130 kgf).

10. The multi-piece solid golf ball of claim 9 wherein the dimples residing adjacent to the equator are 2 to 30% greater in volume than the largest volume dimples in the remaining areas.

11. A multi-piece solid golf ball comprising an elastic solid core, an intermediate layer around the core, composed mainly of an ionomer resin, and a resin cover around the intermediate layer, composed mainly of a urethane elastomer and having a plurality of dimples on its surface, wherein the ball has an equator, and those dimples residing in opposite areas disposed adjacent to the equator have a greater volume than the remaining dimples in other areas, there is no great circle on the spherical surface of the ball that does not intersect with dimples, and the total dimple volume given as the sum of the volumes of all dimples is 280 to 370 $mm^3$, and the ball has opposed poles, and dimples in each of polar areas are arranged generally about the pole and surround the pole such that the line segments connecting the centers of the dimples define a pentagon.

12. A multi-piece solid golf ball comprising an elastic solid core, an intermediate layer around the core, composed mainly of an ionomer resin, and a resin cover around the intermediate layer, composed mainly of a urethane elastomer and having a plurality of dimples on its surface, wherein the ball has an equator, and those dimples residing in opposite areas disposed adjacent to the equator have a greater volume than the remaining dimples in other areas, there is no great circle on the spherical surface of the ball that does not intersect with dimples, and the total dimple volume given as the sum of the volumes of all dimples is 280 to 370 $mm^3$, and the ball has opposed poles, and dimples in each of polar areas are arranged generally about the pole and surround the pole such that the line segments connecting the centers of the dimples define a hexagon.

13. A multi-piece solid golf ball comprising an elastic solid core, an intermediate layer around the core, composed mainly of an ionomer resin, and a resin cover around the intermediate layer, composed mainly of a urethane elastomer and having a plurality of dimples on its surface, wherein the ball has an equator, and those dimples residing in opposite areas disposed adjacent to the equator have a greater depth than the remaining dimples in other areas, and the ball has opposed poles, and dimples in each of polar areas are arranged generally about the pole and surround the pole such that the line segments connecting the centers of the dimples define a pentagon.

14. A multi-piece solid golf ball comprising an elastic solid core, an intermediate layer around the core, composed mainly of an ionomer resin, and a resin cover around the intermediate layer, composed mainly of a urethane elastomer and having a plurality of dimples on its surface, wherein the ball has an equator, and those dimples residing in opposite areas disposed adjacent to the equator have a greater depth than the remaining dimples in other areas and the ball has opposed poles, and dimples in each of polar areas are arranged generally about the pole and surround the pole such that the line segments connecting the centers of the dimples define a hexagon.

15. A multi-piece solid golf ball comprising an elastic solid core, an intermediate layer around the core, composed mainly of an ionomer resin, and a resin cover around the intermediate layer, composed mainly of a urethane elastomer and having a plurality of dimples on its surface, wherein the ball has an equator, and those dimples residing in opposite areas disposed adjacent to the equator have a greater volume than the remaining dimples in other areas, and the ball has opposed poles, and dimples in each of polar areas are arranged generally about the pole and surround the pole such that the line segments connecting the centers of the dimples define a pentagon.

16. A multi-piece solid golf ball comprising an elastic solid core, an intermediate layer around the core, composed mainly of an ionomer resin, and a resin cover around the intermediate layer, composed mainly of a urethane elastomer and having a plurality of dimples on its surface, wherein the ball has an equator, and those dimples residing in opposite areas disposed adjacent to the equator have a greater volume than the remaining dimples in other areas, the ball has opposed poles, and dimples in each of polar areas are arranged generally about the pole and surround the pole such that the line segments connecting the centers of the dimples define a hexagon.

17. A multi-piece solid golf ball comprising an elastic solid core, an intermediate layer around the core, composed mainly of an ionomer resin, and a resin cover around the intermediate layer, composed mainly of a urethane elastomer and having a plurality of dimples on its surface, wherein the ball has an equator, and those dimples residing in opposite areas disposed adjacent to the equator have a greater depth than the remaining dimples in other areas, the total dimple volume given as the sum of the volumes of all dimples is 280 to 370 $mm^3$, the equator is interposed between plural pairs of juxtaposed dimple rows in which the dimples having a greater depth are continuously or intermittently arranged, and wherein said elastic core undergoes a deformation of 2.7 to 4.5 mm when a load applied thereto is increased from 98 N (10 kgf) to 1275 N (130 kgf); a sphere including the elastic core and the intermediate layer undergoes a deformation of 2.5 to 3.5 mm when a load applied thereto is increased from 98 N (10 kgf) to 1275 N (130 kgf); and the solid golf ball comprising the elastic core, the intermediate layer and the cover undergoes a deformation of 2.3 to 3.5 mm when a load applied thereto is increased from 98 N (10 kgf) to 1275 N (130 kgf).

* * * * *